US011638989B2

(12) United States Patent
Green et al.

(10) Patent No.: US 11,638,989 B2
(45) Date of Patent: May 2, 2023

(54) ACTIVE SAFETY SENSING DEVICE AND METHOD FOR A FASTNER TOOL

(71) Applicant: LANTERN HOLDINGS, LLC, Sterling, VA (US)

(72) Inventors: Chad Thomas Green, Sterling, VA (US); Destin Sandlin, Sterling, VA (US); Ty Batchelor, Sterling, VA (US)

(73) Assignee: LANTERN HOLDINGS, LLC, Sterling, VA (US)

( * ) Notice: Subject to any disclaimer, the term of this patent is extended or adjusted under 35 U.S.C. 154(b) by 313 days.

(21) Appl. No.: 17/034,985

(22) Filed: Sep. 28, 2020

(65) Prior Publication Data

US 2021/0094160 A1 Apr. 1, 2021

Related U.S. Application Data

(60) Provisional application No. 62/908,261, filed on Sep. 30, 2019.

(51) Int. Cl.

| | |
|---|---|
| ***B25C 1/00*** | (2006.01) |
| ***B25C 1/04*** | (2006.01) |
| ***B25C 1/06*** | (2006.01) |

(52) U.S. Cl.

CPC ..... *B25C 1/008* (2013.01); *B25C 1/043* (2013.01); *B25C 1/047* (2013.01); *B25C 1/001* (2013.01); *B25C 1/06* (2013.01)

(58) Field of Classification Search

CPC .. B25C 1/008; B25C 1/04; B25C 1/06; B25C 1/041; B25C 1/043; B25C 1/047

See application file for complete search history.

(56) References Cited

U.S. PATENT DOCUMENTS

| | | | | |
|---|---|---|---|---|
| 2015/0122870 | A1* | 5/2015 | Zemlok | A61B 17/07207 227/176.1 |
| 2016/0368126 | A1* | 12/2016 | Liu | B25C 1/008 |
| 2020/0039046 | A1* | 2/2020 | Takidis | B25C 1/06 |

* cited by examiner

*Primary Examiner* — Anna K Kinsaul
*Assistant Examiner* — Veronica Martin
(74) *Attorney, Agent, or Firm* — Birch, Stewart, Kolasch & Birch, LLP

(57) ABSTRACT

An active safety device and method for fastener tools that includes a first sensor that detects a hazardous target; a first driver that drives the fastener a minimal distance into the material, the fastener being conductive and acting as a second sensor; a second driver that drives the fastener into the material; a processor that receives information from the first sensor and determines if a hazardous target is detected by said first sensor and engages a trigger interlock if the hazardous target is not detected the first driver is engaged and said second sensor provides information on the composition of the material to the processor; wherein the processor engages the trigger interlock when it determines if the composition of the material is classified as a hazardous target and otherwise initiates the second driver to drive the fastener into the material.

20 Claims, 5 Drawing Sheets

ACTIVE SAFETY SENSING DEVICE AND METHOD FOR A FASTNER TOOL

CROSS-REFERENCE TO RELATED APPLICATIONS

This application claims the benefit under 35 U.S.C. § 119(e) of the filing date of U.S. Patent Application No. 62/908,261, which was filed on Sep. 30, 2019 and which is incorporated here by reference.

BACKGROUND

This specification relates to active safety devices and methods for fastening devices, such as nail guns.

According to the National Institute for Occupational Safety and Health (NIOSH), nail guns are responsible for about 37,000 emergency room visits each year. Various safety features exist such as interlocking pressure plates on the nose of the nail gun and sequential triggers. The plate restricts the user from firing into open air by requiring that contact is made with the workpiece. Unfortunately, both features are often misused or disabled. The pressure plate may be circumvented by holding down the trigger and allowing the nail gun to fire each time contact is made. This is sometimes referred to as "bump firing." Sequential triggers restrict firing to a single nail for each pull of the trigger, but can also be disabled at the user's option. According to the Occupational Safety and Health Administration (OSHA), "2 out of 5 residential carpenter apprentices experienced a nail gun injury over a four-year period . . . . The risk of a nail gun injury is twice as high when using a multi-shot contact trigger as when using a single-shot sequential trigger nailer."

SUMMARY

Embodiments of the present invention relates to the automatic detection of hazardous targets to inhibit the firing, or actively catch a fastener, such as a nail or screw, as it is exiting from a fastener driving tool. A two-part sensor system as well as a two-stage fastener driving system is utilized. The first part of the sensor system (part 1) may include a capacitive touch sensor on the nose guard of the driving tool. This sensor discriminates skin from wood, roofing material, etc., and locks out all driving functions while the hazard is detected. However, if the user accidentally makes contact with an area of the body that is covered by clothing (a glove for example), a second sensor (second part of the sensor system, part 2), which may also include a capacitive sensor, makes contact with the fastener and works in conjunction with stage 1) of the driving system to limit contact of the fastener with any area of the human body.

The two-part sensor system may be optimized by use of a neural network that has been trained on sensor data from the contact detection system to classify various types of materials including skin of a user. The two-part sensor system can thus distinguish more accurately skin from various materials and thereby provide more reliable system in distinguishing an active safety concern from proper use of the nail gun.

The driving system includes two stages, stage 1 and stage 2. Stage 1 of the driving system may be comprised of a continuously variable driver for testing the hardness and composition of the target material which also provides data to the pre-trained neural network to aide in classification of the material.

Stage 2 of the driving system may include a high-power driver for finishing the fastener into the material. During stage 1 of the driving operation, if a target is classified as hazardous, such as "no resistance" (driving into free air) is determined, stage 2 is locked out, the trigger is rendered inoperable, and the fastener is released from a firing readiness state. Similarly, if a hazardous target such as "human contact" is determined (via capacitive, ultrasonic, or RF sensing), stage 2 is locked out, the trigger is rendered inoperable, and the fastener is released from a firing readiness state. If, however, neither of the aforementioned hazardous targets are determined, the driving resistance is measured, the material is classified, and the finishing driving power for stage 2 is calculated based on the determined classification. Stage 2 of the driving operation is then allowed to continue and, by using the calculated driving power, accurately drives the fastener flush with the target material surface. During the driving operation of stage 2, if part 2 of the sensing system detects a hazardous target, a final high-speed catch system may be engaged. The high-speed catch system, in fractions of a millisecond, catches the nail as it is exiting the tool.

Therefore, safety is improved by avoiding hazardous unintentional firings. Additionally, performance is improved by more accurately driving the fastener. This also avoids fasteners being ejected through the target material and injuring others on the opposite side of the material.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

The specification describes embodiments of the present invention of adaptive, active sensors and drivers for a fastener apparatus such as a nail gun.

Embodiments of the present invention are discussed in relation to a nail gun but may be utilized in any fastener device that includes projecting a fastener into material. The embodiments of the present invention include a two-part sensor system and a two-stage driving system.

Figure 1:
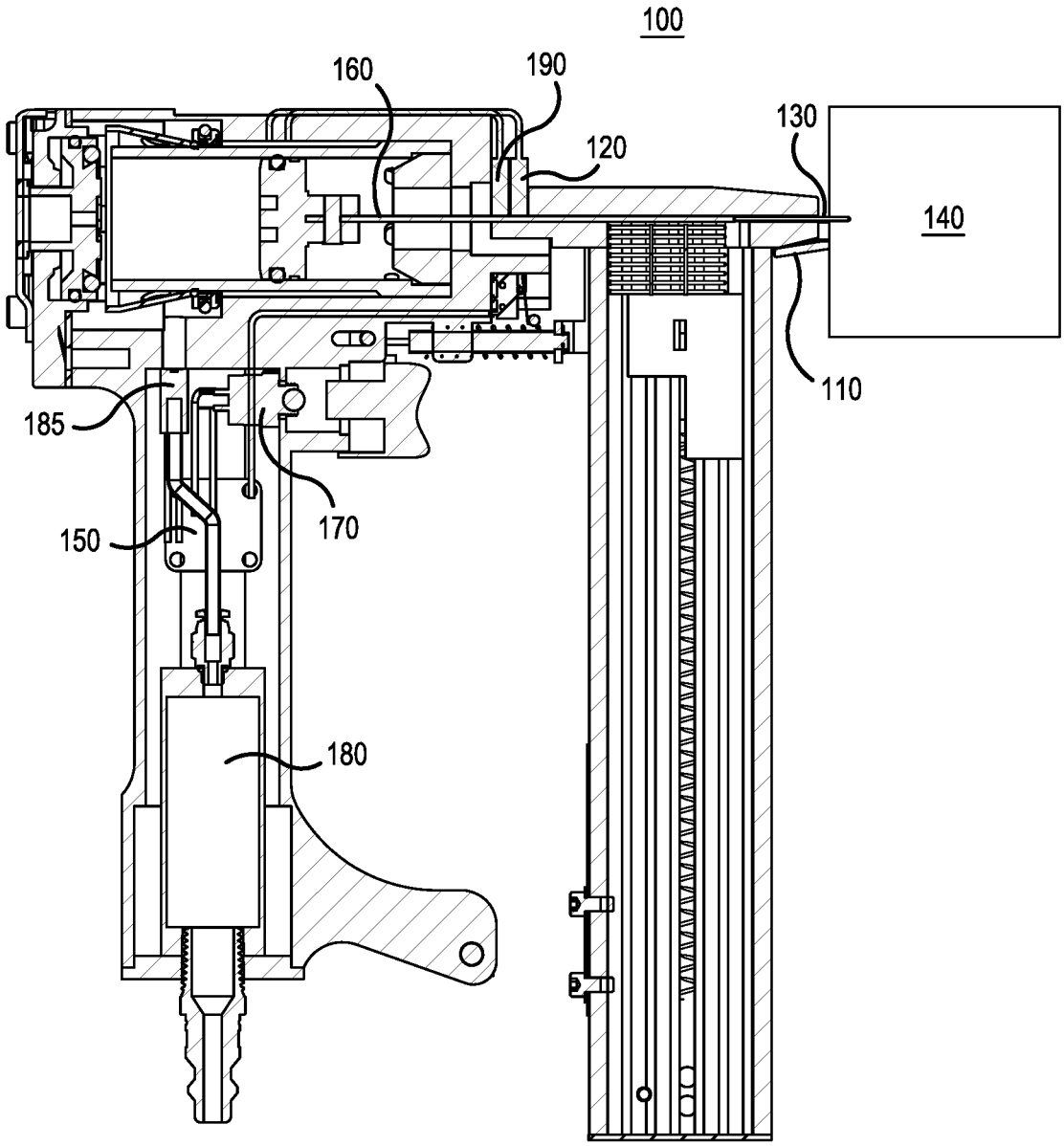
FIG. 1 illustrates an example of the two-part sensor system.

FIG. 1 illustrates a two-part sensor system of the present invention. The two-part sensor system includes a direct contact sensor 110 that is placed external to the nail gun, such as a conductive plate or wire connected to the bumper plate, nose guard, or safety contact pressure plate on the nose of the tool. The direct contact sensor 110 may be a capacitive touch sensor or other equivalent technology which detects skin contact. The fastener 130 (nail, screw, etc.) itself may be conductive and may be used as a contact probe. This is accomplished with a secondary contact sensor 120, which makes electrical contact with the fastener driver 160, allowing electrical signals to flow from the fastener 130 through the fastener driver 160 and be measured by the processor 150. When the fastener 130 is used as a probe, it is initially driven a short distance into the target material 140, the cumulative force required to drive the given distance, the rate at which the drive was able to occur, and the change to the waveform of the electrical signal applied to the fastener are measured. This procedure constitutes stage 1. This measured information is provided to a processor 150 (later discussed) which performs calculations and controls the operation of the fastener driver 160 and safety mechanisms such as trigger Interlock 170 and any additional external processes such as user notifications. The distance that the probe should be driven in stage 1 may be predetermined and can be any distance that allows for the above measurements to be made. Some embodiments of the invention may utilize distances in the range of 1/10"-1/4". The drive pressure to drive the fastener 130 in stage 1 may be a constant drive pressure or pulse-width-modulated or any combination that allows for movement of the fastener 130 by the predetermined distance. For example, the fastener 130 may be percussively driven at a constant frequency with very low duty-cycle (pulse width) initially, then the duty-cycle (pulse width) is gradually increased until the fastener 130, for example the nail head, has moved the predetermined distance. The method for this stage 1 driving procedure is described in more detail below.

Alternatively, an independent density/hardness sensor may be used separately and thus avoid direct contact with the fastener 130. The independent density/hardness sensor may be located adjacent where the fastener 130 exits the fastener apparatus. The independent density/hardness sensor (not shown) may be comprised of a non-contact sensor such as an ultrasonic sensor, an RF sensor such as low-power radar, or a secondary physical contact sensor such as a dedicated probe or vibrometer. A classification of the composition of the target material including density, thickness, and hardness may be determined from the measurements obtained from the sensors in stage 1. Thus, from the classification of the composition of the target material, a determination is made of whether or not a hazardous condition exists—such as skin determined to be in the direct path of the fastener 130—and action is taken to either stop the fastener movement or allow it to proceed. Traditional safety features remain in place, such as the mechanical safety catch, as well as the optional sequential trigger feature that only allows the nail gun to fire once for each pull of the trigger.

FIG. 1 further illustrates a two-stage driving system. Stage 1 is used in conjunction with a probe as discussed above. In stage 1 of the driving system, if the direct contact sensor 110 of the nail gun does not detect a hazardous target, such as skin, the fastener 130 is driven a short distance such as 1/10"-1/4" into the material. The stage 1 driver may be comprised of an electrical solenoid, electrical stepper or servo motor, or mechanical system such as a spring and plunger system, or pneumatic system comprised of a storage plenum 180 with rapid solenoid valve 185 as shown in FIG. 1. In stage 1 the composition of the target material is tested. This testing is a rapid operation, but slower than the stage 2 operation.

The stage 1 drive pressure may be linearly increased, or a given drive pressure may be pulsed at a variable duty-cycle (pulse width) in order to increase the drive pressure from zero to a predetermined value and measure the distance that the fastener 130 moved given the predetermined pressure. Alternatively, a predetermined drive distance may be set and the drive pressure is increased (up to the maximum pressure available) until the predetermined drive distance is achieved. The drive distance is measured by an encoder 190 placed adjacent to the secondary contact sensor 120. Once the predetermined drive distance is achieved, the drive pressure is released. Depending on the given scenario, the peak drive pressure, pressure profile, drive distance, and/or time required to translate the fastener 130 a predetermined distance are stored in memory located in the processor 150. An electrical signal (waveform) is induced onto the fastener 130 and the change in this signal over the drive distance is recorded in the memory. The signal provides information as to the electrical conductivity and change in capacitance as the fastener 130 travels into the material. This sensor data is retrieved from memory by a processor 150 and classification algorithms are performed to provide a determination of the composition of the target material 140. The target material 140 may be determined to be skin, skin under clothing, wood, drywall, electrical wires, pipes, etc. A target is considered hazardous if its composition is determined to be any material or substance which, when driven in stage 2, would cause harm or would create an unsafe condition. Hazardous targets include but are not limited to: skin, free air (lack of target), target too soft, target too hard, electrical wire, conductive pipe, water, etc.

For a more precise classification of the target material 140, the previously mentioned sensor data may be passed through a pre-trained neural network. A detailed description of the method of training, testing, and deploying the neural network is described later. The pre-trained neural network is trained with sensor data from fasteners 130 being driven into a variety of target materials 140, both homogenous and inhomogeneous, including the aforementioned hazardous targets as well as standard targets such as wood, drywall, roofing material, etc. This training allows the neural network to differentiate between hazardous and non-hazardous targets, thus mitigating false alarms and misidentifications.

Based on the classification of stage 1 as well as the known properties of the fastener 130, the finishing force required to drive the fastener 130 through completion of stage 2 is calculated. The calculated finishing force is then supplied by the stage 2 driving mechanism (described below) which then drives the fastener 130 through the target material 140.

For example, if the force required in stage 1 to drive the fastener 130 over a given distance is measured to be below a predetermined safe threshold and also no change to the waveform on the fastener 130 is detected, it is assumed that the fastener 130 is being driven into open air and therefore stage 2 procedures are locked out. This prevents any energy (finishing force) which would have been supplied by the stage 2 driving mechanism from being released. Similarly, if the force required in stage 1 to drive the fastener 130 over a given distance is measured to be within predetermined safe thresholds but the waveform is perturbed in such a way as to indicate contact with a hazardous target such as skin, the trigger Interlock 170 are engaged and the trigger cannot be activated. However, if neither of these and/or other hazardous targets are determined, the finishing force required to drive the fastener 130 through completion of stage 2 is calculated and stage 2 is allowed to proceed.

Stage 2 of the driving system is comprised of a high-energy reservoir as well as an energy transfer instrument and a controller to drive the fastener 130 to its final position. The high-energy reservoir may be comprised of a pneumatic plenum 180 as shown in FIG. 1 with compressed air. The energy transfer instrument for the stored compressed air energy may be comprised of a mechanically or electrically actuated solenoid valve 185 and the controller may be comprised of an electrical circuit which controls current to the electrically actuated valve and is enabled by a processor 150. The high-energy reservoir may also include an electrical battery with a high-energy capacitor for rapid release of the battery's stored energy. The energy transfer instrument for the battery's and/or capacitor's energy may be comprised of a solenoid actuator and the controller may be comprised of an electrical circuit which controls current to the capacitor and/or solenoid and is enabled and/or modulated by a processor 150. The high-energy reservoir may also be comprised of a large spring and plunger system that is coiled mechanically through an electric motor or other actuator. The energy transfer instrument for the spring's energy may be comprised of a mechanically or electrically actuated latch and the controller may be comprised of an electrical circuit which controls current to the latch and is enabled by a processor 150. Alternatively, the high-energy reservoir may be comprised of a combustion chamber and a mixer such as a fan. The energy transfer instrument may be comprised of an ignition source such as a spark plug and the controller may be comprised of an electrical circuit controlling current to the ignition source and enabled by a processor 150.

The necessary driving energy required to be transferred from the high-energy reservoir is calculated based on the finishing force which was calculated in stage 1. Assuming all safe conditions are met, a controlled release of the necessary driving energy is rapidly released via the energy transfer instrument, resulting in the fastener 130 being driven to the desired depth. Because the driving energy is calculated, the driving of the fastener 130 can be controlled to an intended depth. This allows for precision setting of the fastener 130. Thus, if the fastener 130 is desired to be flush with the material, the required portion of the energy stored in the high-energy reservoir can be transferred such that the fastener 130 is driven flush with the target material 140. Further, by using the calculated energy to control the firing, it eliminates any unintended firing of the fastener 130. This includes firing the fastener 130 all the way through the material or setting the fastener 130 too far into the material where it may protrude partially through the material in an unintended manner.

Figure 2:
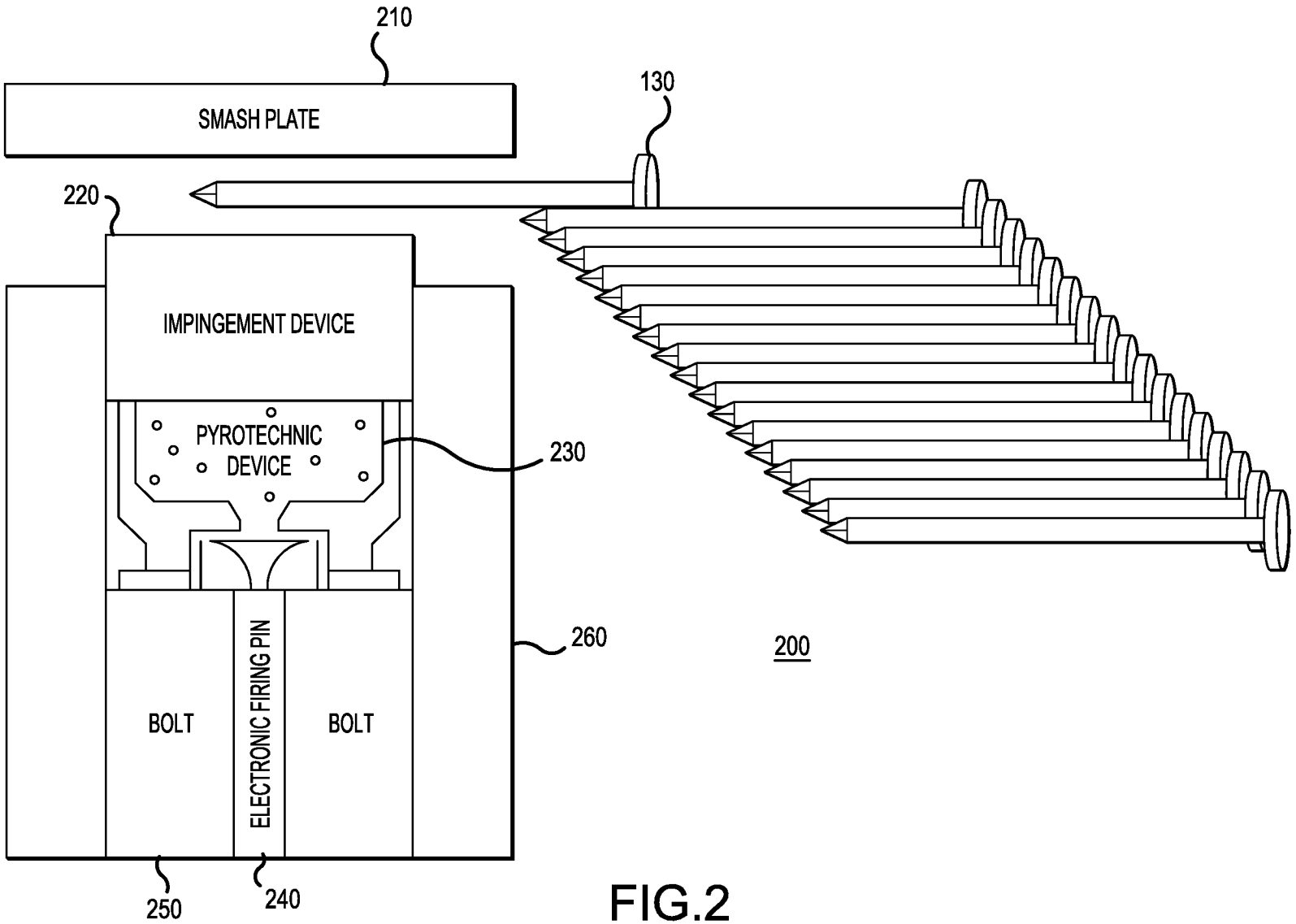
FIG. 2 illustrates an exemplary high-speed catch device.

During operation of the fastening apparatus, the sensing devices are being continuously monitored by the processor 150 for possible contact with skin or other hazardous target determination. In some circumstances a fastening apparatus may not initially be in contact with a hazardous target and ready to perform a stage 2 driving of the fastener 130, however, one or more of the sensing devices discussed above may sense contact with a hazardous target during stage 2 operations. In an embodiment of the invention as disclosed in FIG. 2, a high-speed catch device 200 may be used to capture the fastener 130 should a hazardous target be determined during stage 2 of the driving procedure. The high-speed catch device 200 is located near the exit of the fastening apparatus as a last line of defense in preparation to apply an emergency-stop operation. The high-speed catch device is comprised of an electronic firing pin 240 which may be used to trigger the propellant 230 immediately upon hazardous target determination, which drives the impingement device 220 forward. The impingement device 220 then accelerates toward the smash plate 240 on the opposite side of the firing cavity, impacting the fastener 130 from the side and capturing the fastener 130, halting its forward motion. Not shown is a release valve for removing the drive pressure on the fastener 130, which may be triggered by the motion of the impingement device 220. The chamber 260 for the firing cap can then be opened, for example opening the bolt 250, to remove the spent cap and replace it with a new one. The system is reset by the opening of the chamber 260.

Figure 3:
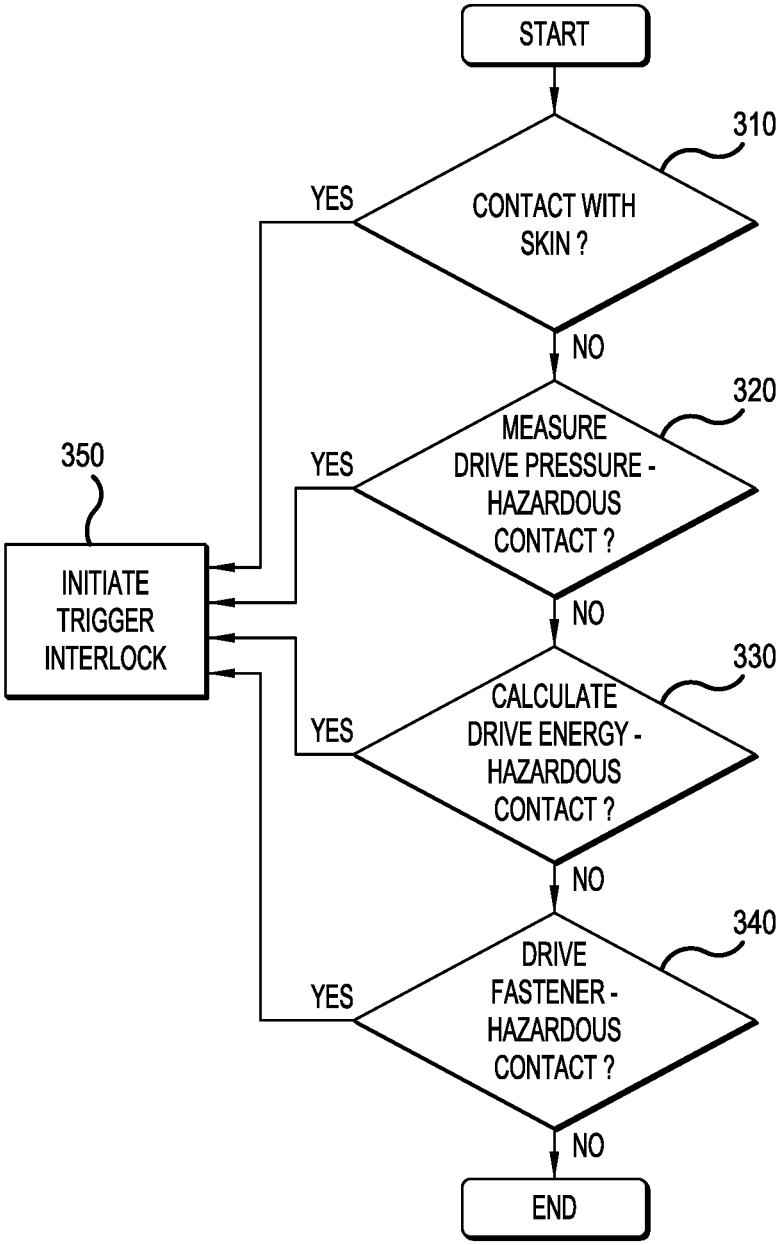
FIG. 3 is an exemplary flow chart of the sensing, lockout and drive method

FIG. 3 describes the hazardous target determination procedure. In step 1 (310), the direct contact sensor (part 1 of the sensor system) is continually measured to detect direct skin contact. If direct skin contact is detected, by the part 1 sensor then a hazardous target is immediately determined and the nail gun's safety features such as a trigger Interlock 350 are activated. If direct contact is not detected by the part 1 sensor, the system proceeds to step 2 (320). In step 2 (320), the variable drive process (stage 1 of the two-stage driving system) is initiated and variable drive pressure is utilized, along with the fastener 130 acting as a probe (part 2 of the two-part sensor). As previously described, if a hazardous target is determined, such as but not limited to open air or skin contact, then the nail gun's safety features/disabling device, such as a trigger Interlock 350 are activated and the system must be reset by releasing the trigger, which also removes pressure from the fastener 130 where the fastener 130 is in a non-firing state.

If no skin contact is detected, then the system proceeds to step 3 (330) which is stage 2 in the two-part driving system. In step 3 (330) the required energy to drive the fastener 130 to the desired depth is calculated by a processor and delivered via the energy transfer instrument such that the appropriate finishing force may be transferred to the fastener 130 to complete stage 2 for the given fastener 130 in the given target material 140.

In step 4, if the appropriate target material 140 composition is determined and no hazardous targets are determined, then the calculated stage 2 finishing force is used to drive the fastener 130 into the material 140. If during any part of step 4, a hazardous target is determined, then in an embodiment of the invention a high-speed catch device 200 may be employed such as discussed above with regard to FIG. 2 to stop the forward motion of the fastener 130 or portions thereof.

Figure 4B:
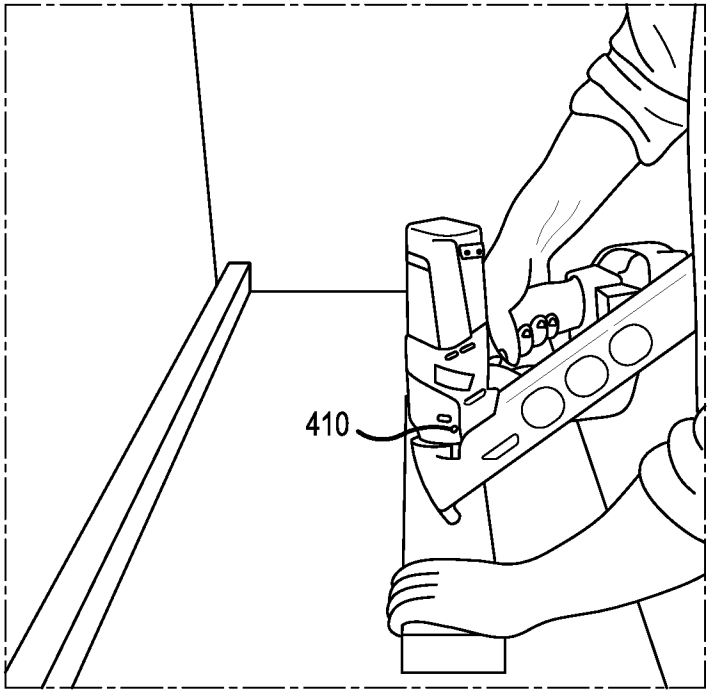
FIG. 4B illustrates an exemplary indicator.
Figure 4A:
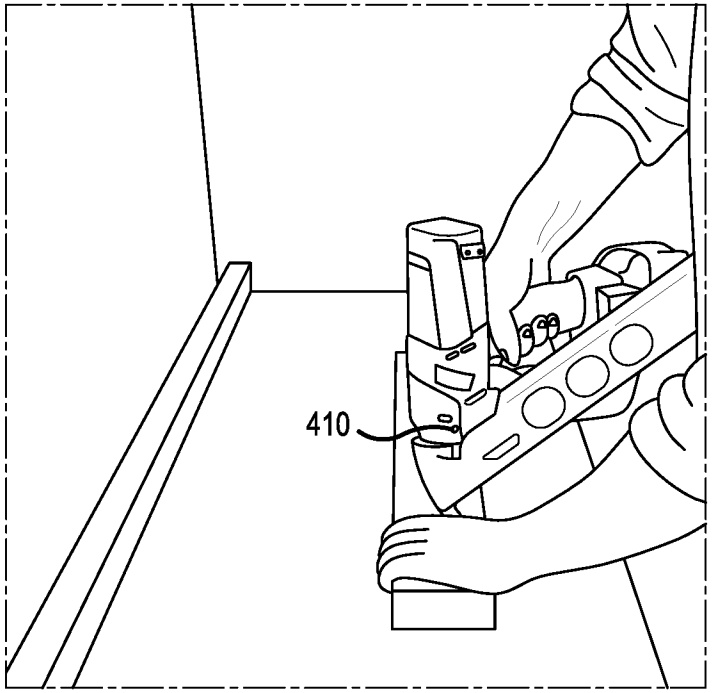
FIG. 4A illustrates an exemplary indicator.

Embodiments of the invention may include one or more user notification indicator features that indicate when a hazardous target is determined. For example, FIG. 4A illustrates a capacitive sensor in the pressure plate of an electric nail gun. When this sensor is tripped by direct skin contact, firing is inhibited by electrically interrupting the signal from the trigger. Additionally, the hazardous situation (direct contact with skin in this case) is identified to a user by a red indicator LED 410 which is illuminated to warn the user. The nail gun cannot fire in this situation. In FIG. 4B, no hazardous target is determined (no direct skin contact) and the LED 410 is off. The nail gun functions as normal in this state. Any type of indicator that identifies when a hazardous target is determined may be used such as visual, acoustic, haptic, etc.

Figure 5:
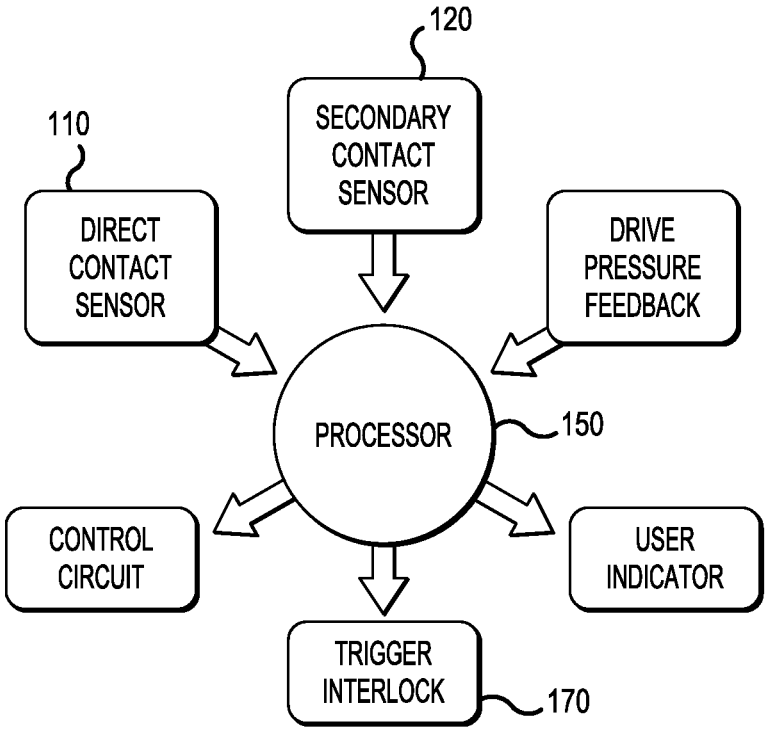
FIG. 5 is a flow chart illustrating the implementation of a processor.

FIG. 5 describes the sensing, processing, and control system internal to the fastener apparatus for making all required calculations and generating the energy required to perform all operations. The input from all sensors is captured by the internal processor 150. All data is stored in a memory device and processed by the internal processor 150 locally and in real-time. The interface to external components such as the control circuit for the electro-mechanical or pneumatic actuators is also controlled and monitored by the processor 150. Safety critical actuators, such as any driving energy, are locked out by traditional mechanical systems such as the mechanical safety catch. The direct contact sensor 110 may also include a direct electrical lockout (not shown, but external to the processor 150) for redundancy and safety.

In embodiments where a neural network is use, the network must be pre-trained. The process of capturing data, training, and validating the neural network is repeated many times until the acceptable performance is obtained. Following validation, the network is optimized to fit and perform within the constraints of a small processor 150 located directly on or within the fastening apparatus. The optimized network is deployed to that device where real-time performance may be measured.

The purpose of the training data is to provide the neural network a very diverse set of data that is representative of a plurality of actual use scenarios. The network requires both the sensor input (each timestamp of sensor input) as well as annotation files with the correct classification which will become the network output. Having accurate annotations is crucial to a high-performing network as the difference between predicted network output and the values found in the annotation files determines the error function that is calculated and back-propagated through the network during training. Any error in the annotation file will adversely affect the performance of the network.

In embodiments of the present invention, the sensor input to the network may be comprised of time-series data, such as the electrical waveform induced onto the actual fastener 130 during stage 1 and stage 2 of the driving procedure, measured driving force over time, measured ultra-sonic sensor data, measured RF data, measured capacitive sensor data, temperature, humidity, inertial data, etc. For each timestamp in the sensor data stream, the appropriate material classification is recorded.

Data is collected while driving various fasteners 130 into a plurality of materials with different thickness, hardness, and density. Non-invasive testing, such as contact testing with a capacitive sensor may be performed on human test subjects, but tests which would perforate the skin in stage 1 or stage 2 will be performed on common human analog test subjects.

Once sufficient data has been captured and annotated, network training begins. The data is consolidated into a training set and test set. The training files are repeatedly fed to the neural network during training routines, while the test set is used exclusively for evaluating the performance of each training cycle. In this manner, the network is always evaluated using test data that it has never seen before.

During the training cycle, hyper-parameters are optimized such as learning rate, batch size, momentum, and weight decay. Additionally, several optimization methods may be explored to improve the accuracy of the network such as Stochastic Gradient Descent or Adam and/or other variants as best practices in training methods evolve.

Once satisfactory network performance has been achieved, a final evaluation step on real-world data is necessary to determine how well the network generalizes to new data, including new users and new user actions for the fastener driver. During this validation process, data is again collected and annotated for future training cycles to remove outliers in performance.

This training sequence is iteratively repeated to continually improve performance and add new test conditions and scenarios.

After training is complete, the network is frozen and optimized for efficient performance on an embedded device. This process may include quantizing the network, removing floating point operations and extraneous test and debug nodes. This improves performance on a resource-constrained device, such as a micro-controller, FPGA, or neural network accelerator. The frozen neural network is included when compiling the run-time executable, machine instructions, etc. Real-time data, as captured by the device, is then passed through the network during live operation of the tool, and real-time classifications of the material are made.

Although the present invention largely describes the implementation in a nail gun, the methods described could apply to drills and other cutting tools in a manner directed to their specific design. For example, the drill bit, rivet gun, die cutter, sewing needle or other perforating implements may act similarly as the fastener 130 and thus the embodiments of the invention implemented based on the specific design of each tool.

Embodiments of the subject matter and the functional operations described in this specification can be implemented in digital electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non transitory storage medium for execution by, or to control the operation of, data processing apparatus. The computer storage medium can be a machine-readable storage device, a machine-readable storage substrate, a random or serial access memory device, or a combination of one or more of them. Alternatively, or in addition, the program instructions can be encoded on an artificially generated propagated signal, e.g., a machine-generated electrical, optical, or electromagnetic signal, that is generated to encode information for transmission to suitable receiver apparatus for execution by a data processing apparatus.

The term "data processing apparatus" refers to data processing hardware and encompasses all kinds of apparatus, devices, and machines for processing data, including by way of example a programmable processor, a computer, or multiple processors or computers. The apparatus can also be, or further include, special purpose logic circuitry, e.g., an FPGA (field programmable gate array) or an ASIC (application specific integrated circuit). The apparatus can optionally include, in addition to hardware, code that creates an execution environment for computer programs, e.g., code that constitutes processor firmware, a protocol stack, a database management system, an operating system, or a combination of one or more of them.

Computers suitable for the execution of a computer program can be based on general or special purpose microprocessors or both, or any other kind of central processing unit. Generally, a central processing unit will receive instructions and data from a read only memory or a random access memory or both. The essential elements of a computer are a central processing unit for performing or executing instructions and one or more memory devices for storing instructions and data. The central processing unit and the memory can be supplemented by, or incorporated in, special purpose logic circuitry. Generally, a computer will also include, or be operatively coupled to receive data from or transfer data to, or both, one or more memory devices for storing data. However, a computer need not have such devices.

While this specification contains many specific implementation details, these should not be construed as limitations on the scope of any invention or on the scope of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claimed combination may be directed to a subcombination or variation of a subcombination.

What is claimed is:

1. An active safety device included in a fastener tool, comprising:

a first sensor that detects a hazardous target;

a first driver that drives the fastener a minimal distance into a material, the fastener being conductive and acting as a second sensor that provides information on the composition of the material;

a second driver that drives the fastener into the material;

a disabling device that disables one or both of said first driver and second driver;

a processor that receives information from the first sensor and determines if a hazardous target is detected by said first sensor and engages a trigger interlock if the hazardous target is detected and if the hazardous target is not detected the first driver is engaged and said second sensor provides information on the composition of the material to the processor;

wherein the processor engages the disabling device when the processor determines if the composition of the material is a hazardous target and initiates the second driver to drive the fastener into the material when the composition of the material is not a hazardous target.

2. The Active safety device of claim 1, wherein the hazardous target is skin.

3. The active safety device of claim 1 wherein the disabling device is a trigger interlock.

4. The active safety device of claim 1 wherein the fastener is a nail or screw.

5. The active safety device of claim 1, wherein the first driver is one of an electrical solenoid, electrical stepper or servo motor, mechanical spring or mechanical plunger system.

6. The active safety device of claim 1, wherein the minimal distance is 1/10-1/4 inch.

7. The active safety device of claim 1, wherein the second sensor during the first drive measures a cumulative force required to drive the fastener the minimal distance, the distance which the fastener moved given an applied force, a rate at which the drive occurred, and a change to the waveform of an electrical signal applied to the fastener while being driven.

8. The active safety device of claim 1, wherein the processor determines, based on the sensor information, the force required for the second driver to drive the fastener into the material at a specified depth.

9. The active safety device of claim 1, wherein the processor is optimized by use of a trained neural network that captures sensor data, trains the neural network based on the captured sensor data, validates the trained data and deploys the trained neural network in the processor.

10. The active safety device of claim 1, further including a high-speed catch device to initiate an emergency-stop operation, the high-speed catch device comprising a smash plate and an impingement device in which the impingement device is propelled using a propellant towards said smash plate during said emergency-stop operation.

11. A method for performing active safety within a fastening tool device, comprising:

determining if the fastening tool is positioned in contact with a hazardous target by use of a first sensor;

driving the fastener a minimal distance into a material, by a first driver, the fastener being conductive and acting as a second sensor that provides information on the composition of the material;

driving the fastener into the material when it is determined by the processor that the material is not the hazardous target;

controlling, by a processor, a disabling device that disables one or both of said first driver and the second driver;

determining, by said processor, if said hazardous target is detected by said first sensor and engaging the trigger interlock if the hazardous target is detected and engaging said first driver if the hazardous target is not detected;

providing, by said second sensor, information on the composition of the material to the processor;

engaging, by said processor, the disabling device when it is determined if the composition of the material is the hazardous target; and initiating the second driver to drive the fastener into the material when the composition of the material is determined to be sufficient to stop the fastener and does not include the hazardous target.

12. The method of claim 11, wherein the hazardous target is skin.

13. The method of claim 11, wherein the disabling device is a trigger interlock.

14. The method of claim 11, wherein the fastener is a nail or screw.

15. The method of claim 11, wherein the first driver is one of an electrical solenoid, electrical stepper or servo motor, mechanical spring or mechanical plunger system.

16. The method of claim 11, wherein the minimal distance is 1/10-1/4 inch.

17. The method of claim 11, wherein the second sensor during the first drive measures a cumulative force required to drive the fastener the minimal distance, the distance which the fastener moved given an applied force, a rate at which the drive occurred, and a change to the waveform of an electrical signal applied to the fastener while being driven.

18. The method of claim 11, wherein the processor determines, based on the sensor information, the force required for the second driver to drive the fastener into the material at a specified depth.

19. The method of claim 11, wherein the processor is optimized by use of a trained neural network that captures sensor data, trains the neural network based on the captured sensor data, validates the trained data and deploys the trained neural network in the processor.

20. The method of claim 11, further initiating an emergency-stop operation by a high-speed catch device, the high-speed catch device comprising a smash plate and an impingement device in which the impingement device is propelled using a propellant towards said smash plate during said emergency-stop operation.

* * * * *